US012207694B2

(12) United States Patent
Horie

(10) Patent No.: US 12,207,694 B2
(45) Date of Patent: Jan. 28, 2025

(54) WIG BASE, WIG CAP, AND WIG

(71) Applicant: Terasu heart Japan Co., Ltd, Osaka (JP)

(72) Inventor: Takayoshi Horie, Osaka (JP)

( * ) Notice: Subject to any disclaimer, the term of this patent is extended or adjusted under 35 U.S.C. 154(b) by 651 days.

(21) Appl. No.: 16/963,232

(22) PCT Filed: Dec. 10, 2018

(86) PCT No.: PCT/JP2018/045332
§ 371 (c)(1),
(2) Date: Jul. 19, 2020

(87) PCT Pub. No.: WO2019/142542
PCT Pub. Date: Jul. 25, 2019

(65) Prior Publication Data

US 2021/0045480 A1 Feb. 18, 2021

(30) Foreign Application Priority Data

Jan. 19, 2018 (JP) ..... 2018-007721

(51) Int. Cl.
*A41G 3/00* (2006.01)

(52) U.S. Cl.
CPC ..... *A41G 3/0041* (2013.01); *A41G 3/005* (2013.01)

(58) Field of Classification Search
None
See application file for complete search history.

(56) References Cited

U.S. PATENT DOCUMENTS 3,485,249 A * 12/1969 Mast ..... A41G 3/00 132/53
4,150,678 A * 4/1979 Photopulos ..... A41G 3/0041 132/53

(Continued)

FOREIGN PATENT DOCUMENTS

CN 102885420 A * 1/2013
JP 7-26331 Y2 6/1995

(Continued)

OTHER PUBLICATIONS https://www.webstaurantstore.com/durable-urethane-hd-1-12-x-2-black-antifatigue-mat-599s1824bk-4-thick/829599S1824BK.html (Year: 2023).*

(Continued)

*Primary Examiner* — Tatiana L Nobrega
(74) *Attorney, Agent, or Firm* — Patshegen IP; Moshe Pinchas

(57) ABSTRACT

Provided are: a wig base or a wig cap, which is capable of improving wearability and fit feeling to the head; and a wig including the wig base or the wig cap.

A wig 100 includes a wig base 1 formed into a cap shape capable of covering the entire head from wearer's ears and nape, in which a bag-shaped pad portion 2 is integrally provided on an occipital region 6 of a back surface of this wig base 1. The bag-shaped pad portion 2 is formed into a substantially fan shape having a hollowed lower portion, and an inside of the pad portion 2 is able to be filled with polyurethane foam 8. At least a part of the pad portion 2 is sewn on the back surface of the wig base 1 so as to be located on a nape hollow 9 (a hollowed portion from the occipital region to the nape) of the wearer's occipital region, and is brought into contact with the nape hollow 9.

4 Claims, 4 Drawing Sheets

(56) References Cited

U.S. PATENT DOCUMENTS

| | | | | | |
|---|---|---|---|---|---|
| 5,005,594 | A * | 4/1991 | Dunagan | A41G 3/0008 | 132/54 |
| 5,025,504 | A * | 6/1991 | Benston | A42C 5/02 | 2/181.8 |
| 5,566,395 | A * | 10/1996 | Nebeker | A42C 5/02 | 2/418 |
| 6,438,761 | B1 * | 8/2002 | McGarrity | A42B 3/00 | 2/410 |
| 2008/0044619 | A1 * | 2/2008 | Rochlin | B68G 1/00 | 428/80 |
| 2014/0128491 | A1 * | 5/2014 | Hayashi | C08G 18/4825 | 521/174 |

FOREIGN PATENT DOCUMENTS

| | | | | |
|---|---|---|---|---|
| JP | 200984707 | * | 4/2009 | A41G 5/00 |
| JP | 201065335 | * | 3/2010 | A41G 3/00 |
| JP | 2011-127228 | A | 6/2011 | |
| JP | 5329878 | B2 | 10/2013 | |
| JP | 2017-008448 | A | 1/2017 | |
| JP | 6062260 | B2 | 1/2017 | |

OTHER PUBLICATIONS https://www.americanfloormats.com/polyurethane-sponge-salon-mats/ (Year: 2023).*
ISR; Japan Patent Office; Feb. 26, 2019.

* cited by examiner

WIG BASE, WIG CAP, AND WIG

TECHNICAL FIELD

The present invention relates to a wig base, a wig cap, and a wig.

BACKGROUND ART

Heretofore, a wig to be worn on the head has been known to include a hair body such as human hair and artificial hair, and a wig base on which the hair body is planted. The wig base is classified into a custom-made type whose size is determined according to a shape of the head of a wearer and a ready-made type (ready-made product) whose size is predetermined. Since the ready-made wig base is formed so as to fit a general head shape, various wigs considering wearing feeling have been proposed. For example, Patent Literature 1 discloses a wig base including an adjuster for making an adjustment to cause the wig base to fit the head. Moreover, though a wig cap (also called an inner cap) may be worn to the head in advance before the wig is worn, this wig cap includes one provided with an adjuster for making an adjustment to cause the wig cap to fit the head as illustrated in Patent Literature 2.

CITATION LIST

Patent Literature

Patent Literature 1: Japanese Patent Laid-Open No. 2011-127228

Patent Literature 2: Japanese Patent Laid-Open No. 2017-008448

SUMMARY OF INVENTION

Technical Problems

However, when the above-described conventional wig base, wig cap and wig are worn by a person whose occipital region is flat, it has been difficult to fix the same firmly to the head, and the same have slipped or fallen off, and have not been able to give the person a sufficient fit feeling. Further, the custom-made type wig has a problem that a time-consuming process is required to bring a cost increase and to require a long time to provide the wig to such a wearer.

In this connection, the present invention has been made in view of such circumstances, and an object of the present invention is to provide a wig base, a wig cap and a wig, which are capable of improving wearability and fit feeling to the head.

Solutions to Problems (1) A wig base or a wig cap according to the present invention includes: a bag-shaped pad portion inside of which is fillable with polyurethane foam, wherein the pad portion is provided so that at least a part of the pad portion comes into contact with a nape hollow located on a wearer's occipital region.

(2) Preferably, the wig base or the wig cap in the above (1) further includes a pocket into which the pad portion is insertable, wherein the pad portion is removable from the pocket.

(3) Preferably, in the wig base or the wig cap in the above (1) or (2), the polyurethane foam is a granular material that is uniformly fillable inside the pad portion.

(4) As another viewpoint, a wig base or wig cap of the present invention may include: a pad portion made of polyurethane foam, wherein the pad portion is provided so that at least a part of the pad portion comes into contact with a nape hollow located on a wearer's occipital region.

(5) Preferably, in the wig base or the wig cap in each of the above (1) to (4), a non-slip portion is provided on at least a surface of the pad portion, the surface coming into contact with the nape hollow.

(6) Preferably, in the wig base or wig cap in each of the above (1) to (5), the pad portion is formed into a substantially fan shape having a hollowed lower portion.

(7) Preferably, in the wig base or the wig cap in each of the above (1) to (6), the polyurethane foam contains toluene diisocyanate and polyether polyol as main components, a glass transition temperature defined to be a temperature corresponding to a peak value of a loss tangent is 0° C. or higher and 40° C. or lower, the loss tangent in a frequency range of 0.1 Hz or more and 100 Hz or less is 0.4 or more at the temperature of 0° C. or more and 40° C. or less, and an average value of the loss tangent in a frequency range of 0.1 Hz or more and 1 Hz or less is equal to or less than an average value of the loss tangent in a frequency range of 10 Hz or more and 100 Hz or less.

(8) A wig of the present invention includes the wig base or the wig cap in any one of the above (1) to (7).

According to the present invention, there can be provided: the wig base or the wig cap, which can improve the wearability and the fit feeling to the head and can give good fit feeling to the wearer; and the wig provided with the wig base or the wig cap.

Further, according to the wig base, the wig cap and the wig according to the present invention, even when a person whose occipital region is flat wears the same, the wearer can easily wear the same, and can obtain a sufficient fit feeling. In particular, according to the wig base, the wig cap and the wig according to the present invention, the wearer him/herself can easily adjust the wearability and the fit feeling to the head.

Further, according to the wig base, the wig cap and the wig according to the present invention, the shape of the occipital region can be adjusted by changing the amount, shape and size of the polyurethane foam in the pad portion or by adjusting the position thereof. That is, the overall shape of the wear's head in the wig base, the wig cap and the wig according to the present invention can be balanced, and eventually, the overall shape of the wearer's head can be made to look beautiful.

DESCRIPTION OF EMBODIMENTS

Figure 1:
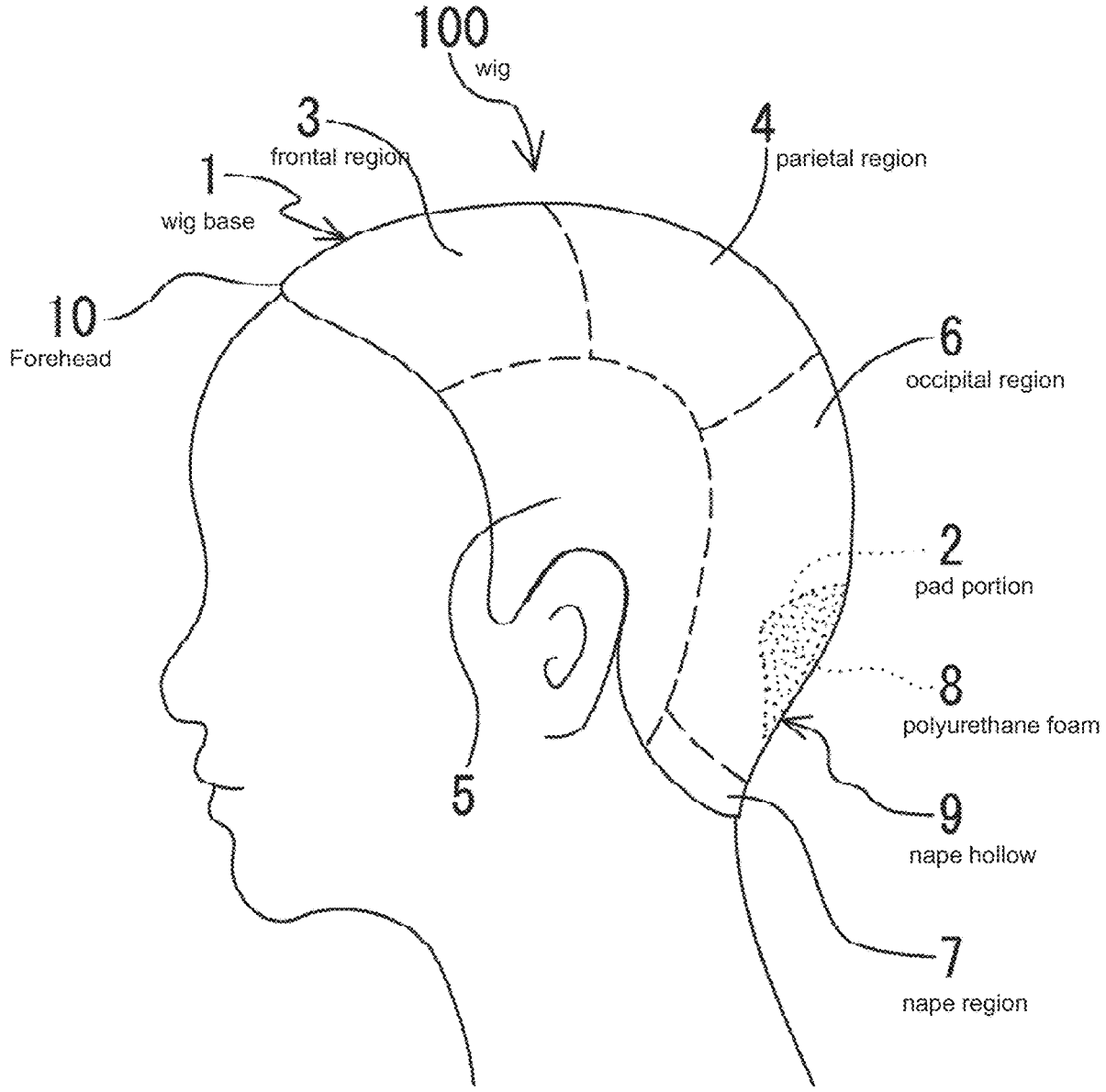
FIG. 1 is a side view illustrating a state where a wig is worn in an embodiment of the present invention.
Figure 2:
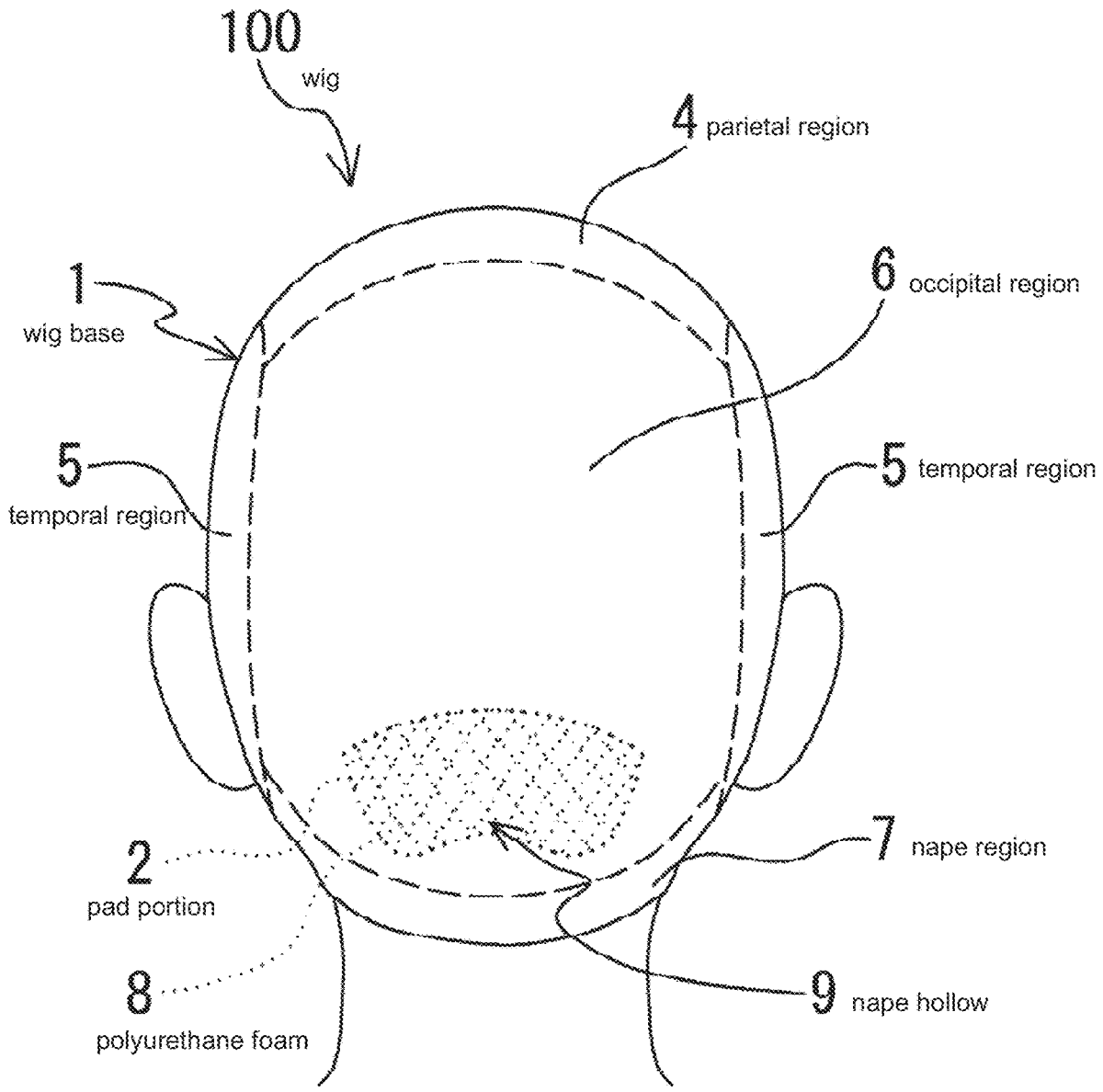
FIG. 2 is a rear view illustrating the state where the wig is worn in the embodiment of the present invention.

Hereinafter, an embodiment of the present invention will be described with reference to FIGS. 1 to 3. In FIG. 1 and FIG. 2, a wig 100 according to the embodiment of the present invention includes a wig base 1 formed into a cap shape capable of covering the entire head from wearer's ears and nape, in which a bag-shaped pad portion 2 is integrally provided on an occipital region 6 of a back surface of this wig base 1. The back surface of the wig base 1 means a surface that comes into contact with wearer's hair or scalp.

The wig base 1 is mainly composed of a flexible net-shaped member formed of a synthetic fiber material, or is composed by partially arranging an artificial skin made of a soft synthetic resin. Although not shown, human hair and/or artificial hair is planted on the entire surface of the wig base 1. Moreover, the wig base 1 includes regions which are a frontal region 3, a parietal region 4, temporal regions 5, an occipital region 6, and a nape region 7. Various known methods can be adopted for attaching and fixing the wig base 1 to the head. Further, as a material of the net-shaped member that constitutes the wig base 1, natural fibers such as cotton, hemp, and silk may be used. Moreover, the net-shaped member that constitutes the wig base 1 may be an integrally molded product made of one piece of cloth, or may be one formed by sewing or adhering a plurality of pieces of cloth to one another.

Figure 3:
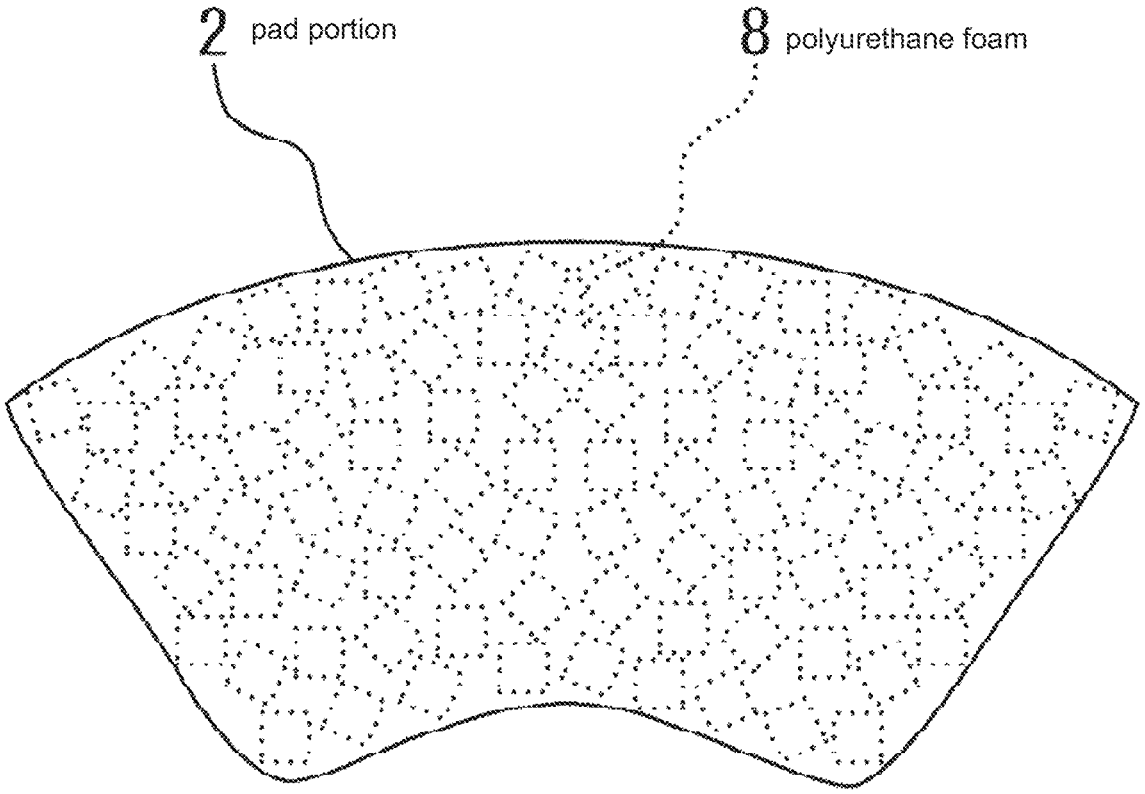
FIG. 3 is a front view illustrating a pad portion of the wig in the embodiment of the present invention.

As illustrated in FIG. 2 and FIG. 3, the bag-shaped pad portion 2 is formed into a substantially fan shape having a hollowed lower portion, and an inside of the pad portion 2 is able to be filled with polyurethane foam 8. Then, as illustrated in FIG. 1, at least a part of the pad portion 2 is sewn on the back surface of the wig base 1 so as to be located on a nape hollow 9 (a hollowed portion from the occipital region to the nape) of the wearer's occipital region, and is brought into contact with the nape hollow 9. Here, the polyurethane foam 8 is a fine granular material, and the inside of the pad portion 2 is uniformly filled with many pieces of the polyurethane foam 8. Further, by filling the inside of the pad portion 2 with many pieces of the fine polyurethane foam 8, the shape of the pad portion 2 can easily follow the shape of the occipital region 6. As a result, the pad portion 2 easily fits the occipital region 6.

The polyurethane foam 8 is preferably cubes of about 5 mm square from the viewpoint of ease of production; however, may have other shapes such as a rectangular parallelepiped, a sphere, a cylinder, and a triangular pyramid. Further, the size of the polyurethane foam 8 may also be changed appropriately according to preference of the wearer. Moreover, the pad portion 2 preferably has a length in the longitudinal direction of about 8 cm to 9 cm and a length in the lateral direction of about 3 cm. Further, a thickness of the pad portion 2 is preferably about 1.5 cm. Even if the wearer moves his/her neck upward, such a pad portion 2 will not get caught on an upper edge of the nape region 7 of the wig base 1. Further, a filling amount of the polyurethane foam 8 can be appropriately changed according to the shape of the wearer's head, and the thickness of the pad portion 2 is made adjustable.

Moreover, the polyurethane foam 8 has a shape followability that allows use thereof while reducing hardness thereof due to heat transfer from a human body and deforming the same to follow a shape of a body surface. The polyurethane foam 8 favorably fits the human body during rest, and has excellent wearability and retention during exercise.

For example, such polyurethane foam 8 is preferred, in which toluene diisocyanate and polyether polyol are contained as main components, a glass transition temperature defined to be a temperature corresponding to a peak value of a loss tangent is 0° C. or higher and 40° C. or lower, the loss tangent in a frequency range of 0.1 Hz or more and 100 Hz or less is 0.4 or more at the temperature of 0° C. or more and 40° C. or less, and an average value of the loss tangent in a frequency range of 0.1 Hz or more and 1 Hz or less (which is a frequency of a human body surface during rest) is equal to or less than an average value of the loss tangent in a frequency range of 10 Hz or more and 100 Hz or less (which is a frequency of the human body surface during exercise). Furthermore, in the polyurethane foam 8, more preferably, the toluene diisocyanate is formed in such a manner that 2,4-toluene diisocyanate and 2,6-toluene diisocyanate are mixed with each other in a ratio of 65:35 to 80:20, and the polyether polyol is polyoxypropylene triol having a number average molecular weight of 700 or more and 3000 or less, polyoxypropylene diol having a number average molecular weight of 400 or more and 2000 or less, or a mixture of the polyoxypropylene triol and the polyoxypropylene diol.

Further, in the polyurethane foam 8, a rate of change of the average value of the loss tangent in the range of frequency of 10 Hz or more and 100 Hz or less to the average value of the loss tangent in the range of frequency of 0.1 Hz or more and 1 Hz or less is preferably 0% or more and 10% or less. Further, in the polyurethane foam 8, preferably, the polyether polyol and the toluene diisocyanate are mixed with each other in a ratio of 100:39.21 to 100:48.77 (mass ratio).

When the wig 100 configured in this way is worn, as illustrated in FIG. 1, the wig base 1 is caught by a wearer's forehead 10 and the wear's nape hollow 9, and is worn so as to cover the entire head. At this time, the polyurethane foam 8 inside the pad portion 2 comes into contact with the scalp of the wearer's occipital region, so that hardness of the polyurethane foam 8 decreases and becomes soft, and the pad portion 2 is deformed to follow a shape of a contact portion thereof, and a shape thereof is retained. Therefore, the pad portion 2 comes to fit the nape hollow 9, the wig base 1 is less likely to slip from the head, the wearability and fit feeling of the wig 100 can be improved, and the wearer can obtain good fit feeling to the head.

Further, even when the wearer whose occipital region is flat wears the wig 100, the occipital region 6 is rounded by adjusting a bulge (thickness) of the bag-shaped pad portion 2 made of the polyurethane foam 8, thus making it easy to catch the wig 100 to the nape hollow 9. Thus, the wearer can easily wear the wig 100. Moreover, since the polyurethane foam 8 has excellent wearability and retention, the wig base 1 is less likely to slip from the head, and the wearer can obtain sufficient fit feeling.

Further, according to the wig 100, the shape of the occipital region can be adjusted by changing the amount, shape and size of the polyurethane foam 8 in the pad portion 2 or adjusting the position thereof. That is, the overall shape of the head of the wearer of the wig 100 can be balanced, and eventually, the overall shape of the wear's head can be made to look beautiful.

Although the embodiment of the present invention has been described above, the embodiment merely exemplifies a specific example, and does not particularly limit the present invention. Specific configurations and the like are appropriately changeable in design. Further, actions and effects, which are described in the embodiment of the invention, merely list the most suitable actions and effects, which result from the present invention, and the actions and effects according to the present invention are not limited to those described in the embodiment of the present invention.

OTHER EMBODIMENTS

In the above embodiment, an example in which the shape of the polyurethane foam filled in the pad portion is a cube is described, but the shape of the polyurethane foam is not particularly limited, and for example, may be a rectangular parallelepiped, a sphere, and the like. Further, one piece of sheet-shaped polyurethane foam may be filled inside the pad portion.

Moreover, in the above embodiment, an example in which the bag-shaped pad portion is sewn on the back surface of the wig base and provided integrally with the wig base is described; however, the present invention is not limited to this. For example, the bag-shaped pad portion may be sewn on a front surface of the wig base and provided integrally with the wig base.

Further, the wig of the present invention may be configured such that a pocket is provided on the front surface or back surface of the wig base, and that the bag-shaped pad portion is inserted and mounted into the pocket. In this case, the wearer can remove the pad portion from the wig base by him/herself, and can change the filling amount of the polyurethane foam in the pad part, so that the wearer can easily adjust the wearability and fit feeling of the wig on the head easily by him/herself.

Further, the wig of the present invention may be configured such that the bag-shaped pad portion is provided on a wig cap removable on an inner surface of the wig body instead of the wig base. Also in this case, the same actions and effects as those of the above-described embodiment can be exerted.

Further, the pad portion and the inner surface of the wig base or the wig cap may be made detachable from each other using a surface fastener.

Moreover, a non-slip portion formed of silicon or a material containing silicon may be provided on at least the surface of the pad portion, which comes into contact with the nape hollow.

Further, the pad portion does not necessarily have to be put in such a bag-shaped body, and may be made of polyurethane foam. Moreover, a non-slip portion formed of silicon or the like may be provided on at least a surface of the pad portion made of polyurethane foam, the surface coming in contact with the nape hollow, or on the entire surface of the pad portion.

Examples

As shown in Table 1 below, wearers were asked to actually wear wig caps similar to that of the above-described embodiment, and a sensory test was performed. As the polyurethane foam 8 used for the pad portion, used was a product name "SMP Foam" made by SMP Technologies Inc. This "SMP Foam" is an example of the polyurethane foam 8. Further, this polyurethane foam was used after being processed into a form of each sample (see each photograph) shown in Table 1 below. Moreover, the pad portion was attached from the inside of the wig cap to a position corresponding to the position of the wearer's nape hollow using Velcro (registered trademark) having a thickness of about 3 mm. Further, each of the wearers (test subject) was asked to wear the wig cap so that the pad portion was located at the nape hollow at the time of wearing this wig cap.

TABLE 1

Figure 4A:
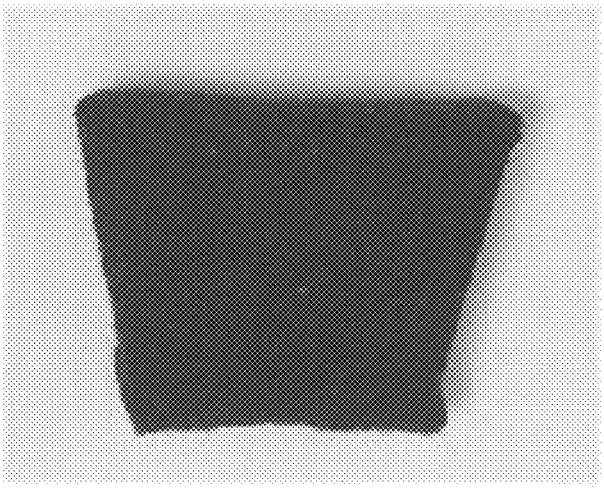
FIG. 4A is a polyurethane foam in accordance with one example of the present invention.
Figure 4B:
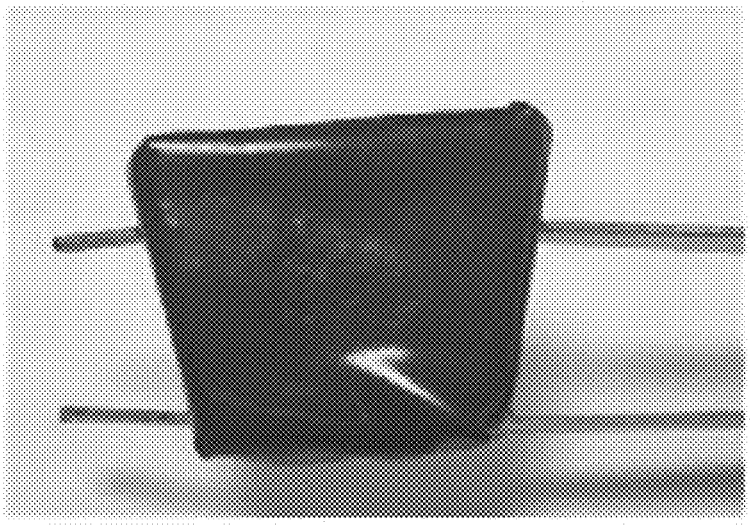
FIG. 4B is a polyurethane foam in accordance with another example of the present invention.

| | | |
|---|---|---|
| 1 | Sample shown in FIG. 4A | One formed by processing a foam (made by SMP Technologies Inc.; product name: SMP Foam) into a size with an upper base of 3 cm × a lower base of 2 cm × a height of 2.5 cm × a thickness of 8 mm and by covering the foam with cloth made of cotton |
| 2 | Sample shown in FIG. 4B | One formed by covering a surface of a foam processed into the same shape as that of Sample 1 with silicon (a thickness of 1 mm) |

For the wig caps using Samples 1 and 2 described above, Table 2 shows questions and answers regarding the sensory test performed for each of the wearers. Here, for example, "S size: 51 cm to 54 cm" indicates that a circumference size of the wearer's head is S size that is 51 cm to 54 cm, and that a wig cap applicable to the wearer's head within this range was used for the sensory test. Moreover, the question "is there stability?" is synonymous with a question whether the wig cap is difficult to slip. The same applies to "M size: 55 cm to 57 cm". Further, in Table 3, the answers from Table 2 are summarized, and an overall evaluation of this sensory test is shown.

TABLE 2

| | Question 1: Does pad portion fit to nape hollow? | | | Question 2: Does wig cap entirely fit the head? | | | Question 3: Is there stability? | | |
|---|---|---|---|---|---|---|---|---|---|
| Sample | YES | NO | UNKNOWN | YES | NO | UNKNOWN | YES | NO | UNKNOWN |
| | S size: 51 cm to 54 cm | | | | | | | | |
| 1 | 4 | 1 | 0 | 3 | 1 | 1 | 0 | 4 | 1 |
| 2 | 5 | 0 | 0 | 4 | 1 | 0 | 5 | 0 | 0 |
| | M size: 55 cm to 57 cm | | | | | | | | |
| 1 | 5 | 0 | 0 | 4 | 1 | 0 | 3 | 2 | 0 |
| 2 | 4 | 0 | 1 | 5 | 0 | 0 | 4 | 0 | 1 |

TABLE 3

| | Aggregate | | | | | | | | | Overall Evaluation | |
|---|---|---|---|---|---|---|---|---|---|---|---|
| | Question 1: Does pad portion fit to nape hollow? | | | Question 2: Does wig cap entirely fit the head? | | | Question 3: Is there stability? | | | | |
| Sample | YES | NO | UNKNOWN | YES | NO | UNKNOWN | YES | NO | UNKNOWN | Total # of yes | Evaluation Rank |
| 1 | 9 | 1 | 0 | 7 | 2 | 1 | 3 | 6 | 1 | 19 | 2 |
| 2 | 9 | 0 | 1 | 9 | 1 | 0 | 9 | 0 | 1 | 27 | 1 |

From results of Table 3, the wig caps using Samples 1 and 2 were able to obtain good answers from the wearers. In particular, a very good answer was able to be obtained for the wig cap to which Sample 2 was attached, Sample 2 using, as the pad portion, polyurethane foam covered with silicon that serves as the non-slip portion. Hence, according to the present example, it was found that the wig cap according to the present invention can cause the pad portion to fit the nape hollow and can be made hard to slip after being worn.

REFERENCE SIGNS LIST

1 wig base
2 pad portion
3 frontal region
4 parietal region
5 temporal region
6 occipital region
7 nape region
8 polyurethane foam
9 nape hollow
10 forehead
100 wig portion is configured to come into contact with a nape region side of the wearer when worn.

The invention claimed is:

1. A wig base or a wig cap comprising:

a substrate having a frontal region, temporal regions, a nape region, an occipital region and a parietal region disposed between said frontal and occipital regions and between said temporal regions, wherein said frontal, temporal and nape regions have outer edges that define a peripheral edge of said substrate, where said peripheral edge forms the entire hairline of said wig base or wig cap, said substrate having an inner surface configured for coming into contact with a wearer's head and an outer surface for coupling hair thereto, a pocket formed in a portion of said occipital region of said substrate disposed adjacent to said nape region, a fillable pad portion inserted within said pocket such that said pad portion is removable from said pocket and at least a part of the pad portion is configured to come into contact with a nape hollow of a wearer's occipital region, a plurality of polyurethane foam pieces disposed inside said pad portion, where said pad portion is configured to permit removing at least a portion of said polyurethane foam pieces and adding more polyurethane foam pieces to change the amount of polyurethane foam pieces in said pad portion, wherein said pad portion has front and back surfaces, where said front and back surfaces have a periphery defined by a convex upper edge, a concave lower edge and linear side edges disposed between the upper and lower edges, where a linear length between opposing ends of the convex upper edge is longer than a linear length between opposing ends of the concave lower edge such that the linear side edges taper from the convex upper edge toward the concave lower edge.

2. The wig base or the wig cap according to claim 1 wherein a non-slip portion is provided on said front surface or said back surface of said fillable pad portion, said non-slip portion coming into contact with the nape hollow.

3. The wig base or the wig cap according to claim 1, wherein said polyurethane foam pieces contain toluene diisocyanate and polyether polyol as main components, wherein a glass transition temperature defined to be a temperature corresponding to a peak value of a loss tangent is 0° C. or higher and 40° C. or lower, wherein the loss tangent in a frequency range of 0.1 Hz or more and 100 Hz or less is 0.4 or more at the temperature of 0° C. or more and 40° C. or less, and wherein an average value of the loss tangent in a frequency range of 0.1 Hz or more and 1 Hz or less is equal to or less than an average value of the loss tangent in a frequency range of 10 Hz or more and 100 Hz or less.

4. A wig comprising:

said wig base or said wig cap according to claim 1; and a plurality of hairs secured to said outer surface of said wig base or said wig cap.

* * * * *